US008136465B2

(12) United States Patent
McCarthy et al.

(10) Patent No.: US 8,136,465 B2
(45) Date of Patent: Mar. 20, 2012

(54) APPARATUS AND METHOD FOR REDUCING MOTION OF A FLOATING VESSEL

(75) Inventors: Vincent George McCarthy, Beckenham (GB); Christopher John Dunlop, Twickenham (GB)

(73) Assignee: Saipem UK Limited, Surrey (GB)

( * ) Notice: Subject to any disclaimer, the term of this patent is extended or adjusted under 35 U.S.C. 154(b) by 0 days.

(21) Appl. No.: 10/574,968

(22) PCT Filed: Oct. 8, 2004

(86) PCT No.: PCT/GB2004/004266

§ 371 (c)(1),
(2), (4) Date: Sep. 20, 2006

(87) PCT Pub. No.: WO2005/035355

PCT Pub. Date: Apr. 21, 2005

(65) Prior Publication Data

US 2007/0175373 A1 Aug. 2, 2007

(30) Foreign Application Priority Data

Oct. 9, 2003 (GB) ..... 0323698.1

(51) Int. Cl.
*B63B 39/03* (2006.01)

(52) U.S. Cl. ..... 114/125; 114/121

(58) Field of Classification Search ..... 114/121–126, 114/50–53, 293, 296; 405/195.1–209, 222–228
See application file for complete search history.

(56) References Cited

U.S. PATENT DOCUMENTS

| | | | | |
|---|---|---|---|---|
| 83,420 A | | 10/1868 | Stoner et al. | |
| 1,299,186 A | * | 4/1919 | Imaizumi | 114/122 |
| 2,561,539 A | * | 7/1951 | Seward | 114/126 |
| 2,895,300 A | * | 7/1959 | Hayward | 405/207 |
| 3,064,613 A | | 11/1962 | Hubick | |
| 3,263,641 A | * | 8/1966 | Stimson | 114/296 |
| 3,407,766 A | | 10/1968 | Bergman et al. | |
| 3,568,620 A | * | 3/1971 | Douglas | 114/125 |
| 3,952,680 A | | 4/1976 | Griffin | |
| 3,965,837 A | | 6/1976 | Michael | |
| 3,978,814 A | | 9/1976 | Willyard | |
| 3,986,471 A | | 10/1976 | Haselton | |
| 4,003,473 A | | 1/1977 | Ryan | |
| RE29,167 E | | 4/1977 | Lloyd, III | |

(Continued)

FOREIGN PATENT DOCUMENTS

EP 1 277 650 A2 1/2003

(Continued)

OTHER PUBLICATIONS

UK Search Reports, issued by the UK Patent Office, Jan. 15, 2004 and Apr. 29, 2004.

(Continued)

*Primary Examiner* — Ed Swinehart

(74) *Attorney, Agent, or Firm* — Buchanan Ingersoll & Rooney PC

(57) ABSTRACT

A vessel (2) comprises a first stabilizer assembly (14) and a second stabilizer assembly, each stabilizer assembly comprising at least one submergible at least partially hollow body; and suspending means (16) for suspending the or each body from the vessel, the first and second stabilizer assemblies being suspended from substantially opposite sides of the vessel. Fins (22) are provided on the stabilizer assembly.

43 Claims, 6 Drawing Sheets

U.S. PATENT DOCUMENTS

| | | | | | |
|---|---|---|---|---|---|
| 4,040,265 | A | | 8/1977 | Hellerman et al. | |
| 4,070,982 | A | | 1/1978 | Willyard | |
| 4,140,074 | A | | 2/1979 | Bergman | |
| 4,176,614 | A | | 12/1979 | Goss et al. | |
| 4,232,903 | A | | 11/1980 | Welling et al. | |
| 4,261,278 | A | | 4/1981 | Gaudin | |
| 4,276,851 | A | | 7/1981 | Coleman | |
| 4,279,047 | A | | 7/1981 | van Heijst | |
| 4,321,720 | A | * | 3/1982 | Havre | 441/5 |
| 4,326,479 | A | | 4/1982 | Kawasaki | |
| 4,366,766 | A | | 1/1983 | Bergman | |
| 4,435,108 | A | | 3/1984 | Hampton | |
| 4,441,448 | A | | 4/1984 | Hillberg | |
| 4,458,619 | A | | 7/1984 | Bergman | |
| 4,534,740 | A | * | 8/1985 | Poldervaart | 441/3 |
| 4,576,520 | A | | 3/1986 | Suh et al. | |
| 4,666,411 | A | | 5/1987 | Silvester | |
| 4,786,266 | A | | 11/1988 | Fozard et al. | |
| 4,928,263 | A | | 5/1990 | Armstrong et al. | |
| 5,072,579 | A | | 12/1991 | Gongwer | |
| 5,095,839 | A | | 3/1992 | Peterson | |
| 5,144,904 | A | | 9/1992 | Weldon | |
| 5,215,024 | A | | 6/1993 | McAllister | |
| 5,237,947 | A | * | 8/1993 | Manning | 114/61.16 |
| 5,406,725 | A | | 4/1995 | Breese | |
| 5,524,567 | A | | 6/1996 | Astley et al. | |
| 5,558,036 | A | | 9/1996 | Hara | |
| 5,787,832 | A | | 8/1998 | Spinka | |
| 6,059,236 | A | | 5/2000 | Tsunoda | |
| 6,073,573 | A | * | 6/2000 | Gruber | 114/264 |
| 6,164,230 | A | | 12/2000 | Beauchamp | |
| 6,257,165 | B1 | * | 7/2001 | Danos et al. | 114/265 |
| 6,293,216 | B1 | | 9/2001 | Barsumian | |
| 6,431,105 | B2 | | 8/2002 | Haram | |
| 6,439,147 | B2 | | 8/2002 | Cottrell et al. | |
| 6,439,149 | B1 | | 8/2002 | Hile | |
| 6,487,982 | B2 | | 12/2002 | Takahashi et al. | |
| 6,655,312 | B1 | * | 12/2003 | Pollack | 114/293 |
| 2003/0154896 | A1 | | 8/2003 | Schmidt | |

FOREIGN PATENT DOCUMENTS

| | | | | |
|---|---|---|---|---|
| FR | 2 769 578 | | | 4/1999 |
| FR | 2 769 578 | A1 | | 4/1999 |
| GB | 380051 | | | 9/1932 |
| GB | 2 043 571 | | | 10/1980 |
| GB | 2 219 973 | A | | 12/1989 |
| JP | 55148681 | A | * | 11/1980 |
| JP | 61-077591 | A | | 4/1986 |
| JP | 9-071293 | A | | 3/1997 |
| JP | 2002-068079 | A | | 3/2002 |
| NL | 1020053 | | | 8/2003 |
| NL | 1020053 | C | | 8/2003 |

OTHER PUBLICATIONS

International Search Report, issued by the EPO, Jan. 18, 2005.

* cited by examiner

APPARATUS AND METHOD FOR REDUCING MOTION OF A FLOATING VESSEL

CROSS-REFERENCE TO RELATED APPLICATIONS

This application is a national stage filing under 35 U.S.C. §371 of International Application No. PCT/GB04/04266, filed on Oct. 8, 2004, which claims benefit of United Kingdom Application No. 0323698.1; filed on Oct. 9, 2003, the entire contents of which are hereby incorporated by reference in their entireties for all purposes.

FIELD OF THE INVENTION

The present invention relates to an apparatus and method for reducing motion of a floating vessel. In particular, but not exclusively, the invention relates to an apparatus and method for reducing the roll of a large floating vessel.

BACKGROUND OF THE INVENTION

It is well known that ships, barges and other floating platforms roll, pitch and heave at sea and that such motion is undesirable in many fields. For example, such motion may be particularly undesirable when loading and unloading to and from the vessel. This is particularly the case for vessels involved with the offshore oil and gas industries. In that application it is common to unload and load, from and to a stationary structure e.g. a deck supported on a jacket on the sea bed or from and to another vessel.

Additionally, in the field of offshore gas and oil, the vessels may be extremely large so that, whilst the movement of the vessel is not very great when expressed in degrees of inclination, the movement at deck height is considerable, causing difficulties even in relatively calm conditions.

There are many known systems which aim to reduce roll and/or pitch motion of floating vessels. There are some systems that have been designed for relatively small vessels. For example, GB 2219973 describes a vessel in the hull of which there is a passageway which allows the free flow of water through it. As the passageway fills and drains, the natural period of the pitching/rolling motion is increased and the motion response of the vessel is reduced. In an improvement on this arrangement, such a tank may be connected to a pump so that the filling and draining of the tank can be controlled at least partially. However, such systerns are integral with the vessel itself and are difficult to install and costly and are not able to be easily transferred from one vessel to another.

Another system which aims to reduce instability of a larger vessel is described in U.S. Pat. No. 5,787,832. In that system, stabilizer assemblies are attached to the hull of the vessel. Each assembly includes an outrigger arm and a float arm which has a float attached to one end. The floats are in contact with the water surface at all times and the system works by increasing the effective width of the vessel so as to increase the natural period of its rolling/pitching motion.

Each stabilizer assembly has to be attached to the vessel through a very strong fastening that has to bear very high loads. U.S. Pat. No. 3,407,766 describes another system which aims to reduce the instability of a larger vessel by providing a stabilizing body below the vessel and connecting it by rigid struts such as steel I-beams which are able to transmit a force moment back to the vessel. A major drawback to an arrangement of this kind is the very considerable strength required of the struts in order to transmit force moment from the stabilizing body to the vessel.

BRIEF SUMMARY OF THE INVENTION

It is an object of the invention to provide an apparatus and method which avoids or mitigates the problems of known stabilizing systems described above.

According to a first aspect of the invention, there is provided a vessel comprising which carries a first stabilizer assembly and a second stabilizer assembly, each stabilizer assembly comprising:

at least one submergible at least partially hollow body;

and suspending means for suspending the or each body from the vessel, the first and second stabilizer assemblies being suspended from substantially opposite sides of the vessel.

Such stabilizer assemblies can be installed in port or at sea and are able to be adapted to be used with any suitable vessel. Because they are at least partially hollow, they can be relatively large for a given mass and the suspending of the assemblies from the vessel can be accomplished relatively easily. Each stabilizer assembly is arranged to apply via the suspending means a downwardly directed force on the side of the vessel from which it is suspended when that side of the vessel moves upwards.

Typically, one stabilizer assembly is suspended from the port side of the vessel and one stabilizer assembly is suspended from the starboard side of the vessel. This reduces the roll of the vessel. The invention is, however, applicable to any kind of vessel some of which may not have clearly defined port and starboard sides (or bow and stern ends). It should be understood, however, that what are referred to herein as the sides of the vessel are those parts of the vessel that rise and fall when the vessel undergoes a rocking motion. The term does not necessarily refer to the port and starboard sides of the vessel.

Often the first stabilizer assembly will comprise a single submergible body but it may comprise:

a first submergible at least partially hollow body and a second submergible at least partially hollow body;

first suspending means for suspending the first body from the vessel; and second suspending means for suspending the second body from the first body.

Similarly, the second stabilizer assembly will often comprise a single submergible body but it may comprise:

a first submergible at least partially hollow body and a second submergible at least partially hollow body;

first suspending means for suspending the first body from the vessel; and second suspending means for suspending the second body from the first body.

The vessel may further carry a third stabilizer assembly, the third stabilizer assembly comprising:

at least one submergible at least partially hollow body; and suspending means for suspending the or each body from the vessel.

In one embodiment, the first stabilizer assembly is suspended near the bow of the vessel on one side, the third stabilizer assembly is suspended near the stern of the vessel on said one side and the second stabilizer assembly is suspended amidships on the other side of the vessel.

The above embodiments using three stabilizer assemblies are known as asymmetric arrangements.

Like the first and second stabilizer assemblies, the third stabilizer assembly may comprise: a first submergible at least partially hollow body and a second submergible hollow body; first suspending means for suspending the first body from the vessel; and second suspending means for suspending the second body from the first body.

The vessel may further carry a fourth stabilizer assembly, the fourth stabilizer assembly comprising:

at least one submergible at least partially hollow body; and suspending means for suspending the or each body from the vessel.

The fourth stabilizer assembly may be suspended from the port or starboard side of the vessel.

In one embodiment, the first stabilizer assembly is suspended near the bow of the vessel on one side, the second stabilizer assembly is suspended near the bow of the vessel on the other side, the third stabilizer assembly is suspended near the stern of the vessel on said one side and the fourth stabilizer assembly is suspended near the stern of the vessel on the other side.

In another embodiment, the first stabilizer assembly is suspended near the bow of the vessel on one side, the second stabilizer assembly is suspended near the stern of the vessel on said one side and the third and fourth stabilizer assemblies are suspended amidships on the other side of the vessel.

It will be understood that the assemblies may be arranged in any of a wide variety of configurations. If the submergible bodies of the assemblies are all of substantially the same size, then it may be advantageous for the same number of bodies to be provided on each side of the vessel.

The reduction of vessel motion relies upon the suspending means being able to apply downwardly directed loads resisting upward movement and the suspending means is therefore advantageously capable of bearing high tension loads. Whilst the suspending means may be capable of bearing high compressive loads too, that is not necessary and it may be more economical and simple not to provide for that. Thus the suspending means may be capable of bearing tension loads of more than one hundred times the loads it is capable of bearing in compression. The suspending means may comprise elongate flexible members, for example, chains, ropes or cables. The or each body is preferably attached to the suspending means at a plurality of locations; for example an elongate body may be attached to a respective elongate flexible member in the region of each of the opposite ends of the body.

Each body is preferably large and is also preferably elongate. Thus in a case where each body is elongate, it may have a cross-sectional area greater than 4 m2 and preferably greater than 10 m. Each body may comprise one or more closed or closable spaces having a combined volume of more than 50 m3 and preferably more than 300 m3. The closed space or spaces are preferably sealed or salable but they may alternatively allow some fluid transfer in and/or out of the space or spaces. In a case where the body is elongate it is preferably suspended with the longitudinal axis of the body substantially horizontal.

Each body may comprise at least one ballast tank. Preferably, each body comprises a plurality of ballast tanks, each separately ballastable. If the bodies are ballastable, the bodies can be suitably ballasted so that the rolling can be controlled to be dependent on the force and period of the waves. Thus, the amount of damping of the rolling motion can be adjusted according to the conditions. In addition, if it is required to unload or load from or to the vessel to or from another vessel, the amount of damping can be adjusted to bring the vessel into line with the other vessel so that unloading and loading is facilitated.

Preferably, each stabilizer assembly further comprises at least one fin projecting from the or each body. The fins increase the drag on the bodies as they move through the water.

The size and shape of the fins is variable. For example, the fins may be straight or curved. In one embodiment, the at least one fin is pivotable relative to the or each body to restrict movement of the body in one direction (upwardly through water) more than in another direction (downwardly).

This is useful because it is often required that there is more drag on the bodies when they are moving vertically upward than when they are moving vertically downward and the fins can be pivotable accordingly. Alternatively, the fins can be shaped be so that there is more drag in one direction than in the other direction.

Preferably, each body is substantially cylindrical and/or prism shaped. In one embodiment, the body is in the form of a tube.

The body may have a round, and preferably a circular, cross section. Alternatively, the body may have a rectangular cross section, for example a square cross section. Alternatively, the body may have a triangular cross section.

In one embodiment, one or both ends of the body are substantially conical. This is advantageous because it facilitates transport. The bodies may, for example, be attached to the vessel to be towed beneath the water line to the desired location, at which point they can be attached to the vessel at the appropriate points. Having conical ends facilitates towing. The bodies may alternatively have hemispherical or rounded ends or any other shape which facilitates towing.

Consideration needs to be given to transferring loads from the suspending means to the vessel structure. Accordingly there is preferably provided a load transfer structure connected between the vessel structure and the suspending means for transferring loads from the suspending means to the vessel structure. In a preferred embodiment of the invention the load transfer structure is provided by one or more saddles for attaching to the vessel, to support the suspending means. The saddles may be attached at the edge of the deck of the vessel at the port or starboard side. The saddles may be attached when the vessel is in port or when the vessel is at sea. The saddles extend the width of the vessel so that the bodies are suspended from points which are slightly further apart than the width of the vessel itself.

In the preferred embodiment of the invention it is only vertical loads from the suspending means that are to be transferred and it is therefore preferred that only vertical loads are arranged to be transferred from the suspending means to the vessel. That may result from the nature of the suspending means (for example if the suspending means is an elongate flexible member), or from the nature of a coupling.

The suspending means of the first stabilizer assembly may be connected to the suspending means of the second stabilizer assembly. That connection is preferably a structural connection made directly or indirectly. If made indirectly it is preferably made through an additional structure separate from the vessel structure.

According to a second aspect of the invention, there is provided an apparatus for reducing vessel motion comprising: a first stabilizer assembly and a second stabilizer assembly, each stabilizer assembly comprising: at least one submergible at least partially hollow body; and suspending means for suspending the or each body from the vessel, the first and second stabilizer assemblies being suitable for locating at substantially opposite portions of the vessel.

Each body may comprise at least one ballast tank. Preferably, each body comprises a plurality of ballast tanks, each separately ballastable.

Preferably, each stabilizer assembly further comprises at least one fin projecting from each body. Even more preferably, the at least one fin is pivotable relative to each body to restrict movement of the body in one direction more than in another direction.

Advantageously, each body is substantially cylindrical and/or prism shaped. In one embodiment, the body has a round, and preferably a circular, cross section. In another embodiment, the body has a rectangular cross section, for example a square cross section. In another embodiment, the body has a triangular cross section.

One or both ends of the body may be substantially conical, hemispherical or rounded. This facilitates transport by towing.

The apparatus may further comprise saddles for attaching to the vessel, to support the suspending means. The saddles may be attached at the edge of the deck of the vessel at the port or starboard side. The saddles may be attached when the vessel is in port or when the vessel is at sea. The saddles extend the width of the vessel so that the bodies are suspended from points which are slightly further apart than the width of the vessel itself. This further stabilizes the vessel.

Preferably, the suspending means of the first stabilizer assembly is connected to the suspending means of the second stabilizer assembly. That connection is preferably a structural connection made directly or indirectly. If made indirectly it is preferably made through an additional structure separate from the vessel structure.

According to a third aspect of the invention, there is provided a submergible body in the form of an at least partially hollow tube, for reducing motion of a water-borne vessel comprising: at least one ballast tank; and at least one projecting fin for increasing the drag of the body through water.

Preferably the body comprises a plurality of ballast tanks, each separately ballastable.

In one embodiment, the tube has a circular cross section.

In another embodiment, the tube has a rectangular cross section, for example a square cross section. In another embodiment, the tube has a triangular cross section.

One or both ends of the tube may be substantially conical.

This facilitates transport of the tubes by towing.

Alternatively, one or both ends of the tube may be rounded or hemispherical or any other shape which facilitates transport by towing.

The or each fin may be pivotable relative to the tube to restrict movement of the body through water in one direction more than in another direction.

According to a fourth aspect of the invention, there is provided a method for reducing motion of a water-borne vessel comprising: suspending at least two at least partially hollow bodies below the water line from substantially opposite portions of the vessel.

Preferably, the method further comprises ballasting each body.

It should be understood that in the description above, where a feature is described with regard to one aspect of the invention, it may also where appropriate be employed in respect of another aspect of the invention. Thus, for example, the method of the fourth aspect of the invention may be employed with a vessel of any of the forms defined according to the first aspect of the invention.

BRIEF DESCRIPTION OF THE DRAWINGS

An embodiment of the invention will now be described with reference to the accompanying drawings of which.

DETAILED DESCRIPTION OF THE INVENTION

Figure 1:
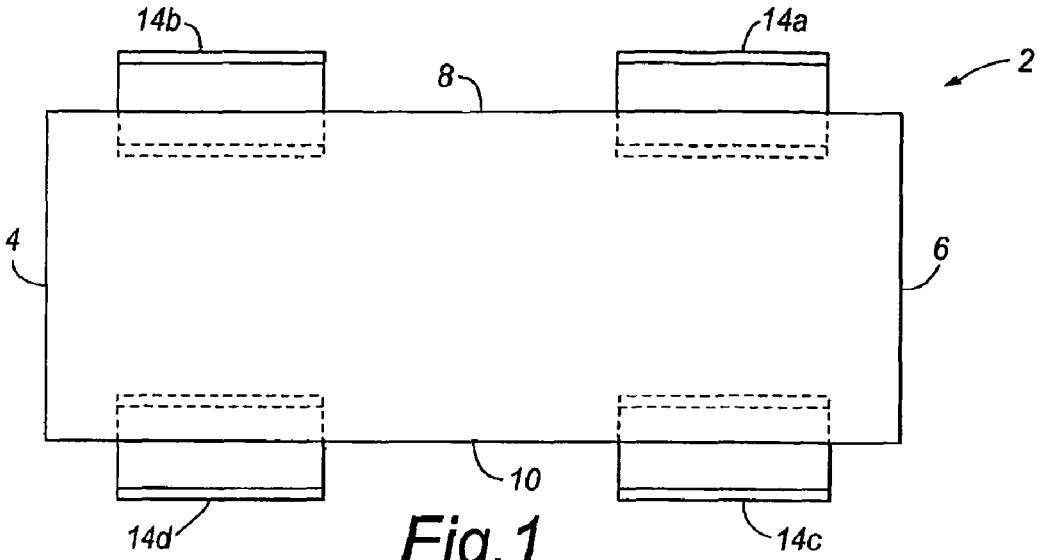
FIG. 1 is a plan view of a vessel including stabilizing apparatus according to the invention.
Figure 2:
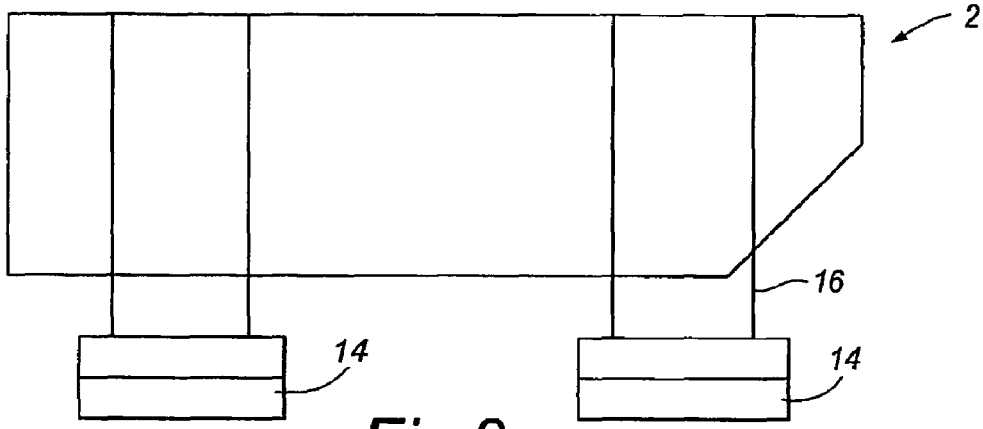
FIG. 2 is a side elevation view of the vessel of FIG. 1.
Figure 3:
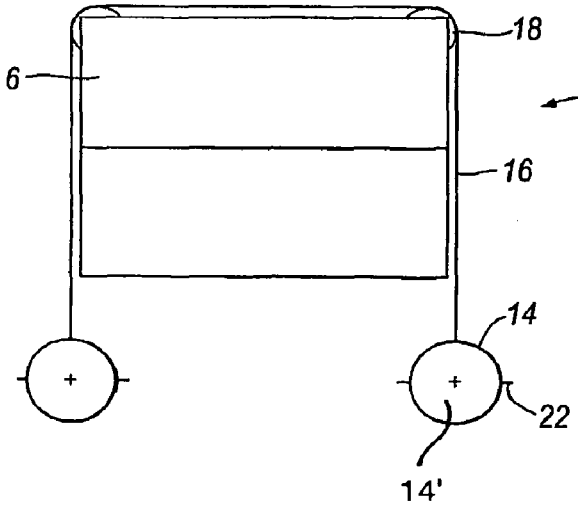
FIG. 3 is a front elevation view of the vessel of FIGS. 1 and 2.

FIGS. 1, 2 and 3 show a vessel 2 having a stern 4, a bow 6, a port side 8, a starboard side 10 and a deck 12. Suspended from the vessel are four tubes 14, two tubes close to the port side 8 and two tubes close to the starboard side 10. One port side tube 14*a* is located near the bow of the vessel. One port side tube 14*b* is located near the stern of the vessel.

One starboard side tube 14*c* is located near the bow of the vessel. One starboard side tube 14*d* is located near the stern of the vessel. Each tube 14 is suspended from the vessel by two chains 16. The chains 16 from opposite tubes 14*a*, 14*c* and 14*b*, 14*d* are linked close to the centre of the deck 12. As shown in the drawings the tubes are arranged with their longitudinal axes horizontal.

The vessel includes saddles 18 located at the edge between the deck 12 and the port side 8 and the deck 12 and the starboard side 10, support the chains 16. This ensures that the chains 16 remain clear of the sides of the vessel even when the vessel rolls a certain amount.

Each tube 14 is substantially cylindrical. Each tube includes a number of ballast tanks 14' which can be separately ballasted and deballasted thus allowing the mass of the tubes 14 in the water to be controlled. Each tube 14 also includes two horizontal fins 22. The horizontal fins 22 impede movement at speed of the tubes 14 in the vertical direction.

As the vessel rolls, the port side 8 and the starboard side 10 alternately rise and fall. As the port side 8 rises, the port side tubes 14*a* and 14*b* are required to move upwards and the mass of the tubes and the projecting fins impede that upwards motion. More particularly, the necessary acceleration upwards of the tubes is limited by the inertia of the tubes, whilst the tubes and fins are also resistant to travel through the water at high velocity. Similarly, as the starboard side 10 rises, the starboard side tubes 14*c* and 14*d* are required to move upwards and the mass of the tubes and the projecting fins impede that upwards motion. Thus the rolling motion of the vessel 2 is reduced; the degree of rolling is reduced and the period of the motion is increased i.e. the frequency is reduced.

The tubes, chains and saddles may be attached to the vessel in port or at sea.

The diameter and length of each tube is variable to suit the application. The material used to construct the tube is variable and this will depend upon the desired mass of each tube. The mass of each tube affects the acceleration of the tubes through the water. The number of ballast tanks in each tube is variable and the tubes are designed to be ballastable on deck so that the tubes can easily be towed in the water to facilitate transport. The cross section of the tubes is also variable (see FIGS. 10 to 12). The tubes may have conical ends in order to facilitate transport. The length of the chains is also variable. The size and shape of the fins is variable and the fins may be pivotable in relation to the tube such that, as the tube moves vertically upwards the fins project horizontally to impede the upwards motion, but as the tube moves vertically downwards the fins pivot inwards so as not to impede the downwards motion. The size and shape of the fins affect the speed of the tubes through the water.

In one embodiment, the tubes are 40 m long, with conical ends, and 5 m in diameter. Each tube weighs 200 tonnes and comprises ten separate ballast tanks. Each tube has two projecting 75 cm fins, which extend along all of the tube and cones. The tubes can be suspended 25 m below the water line.

Figure 4:
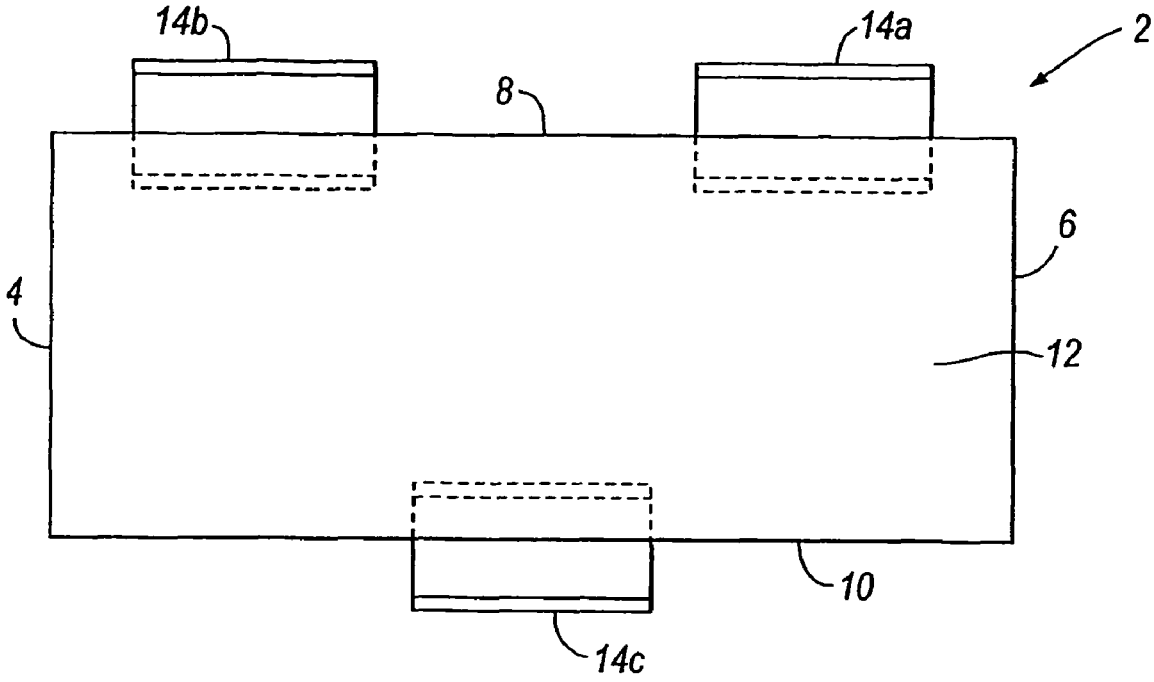
FIG. 4 is a plan view of a vessel having a first alternative stabilizing arrangement.
Figure 5:
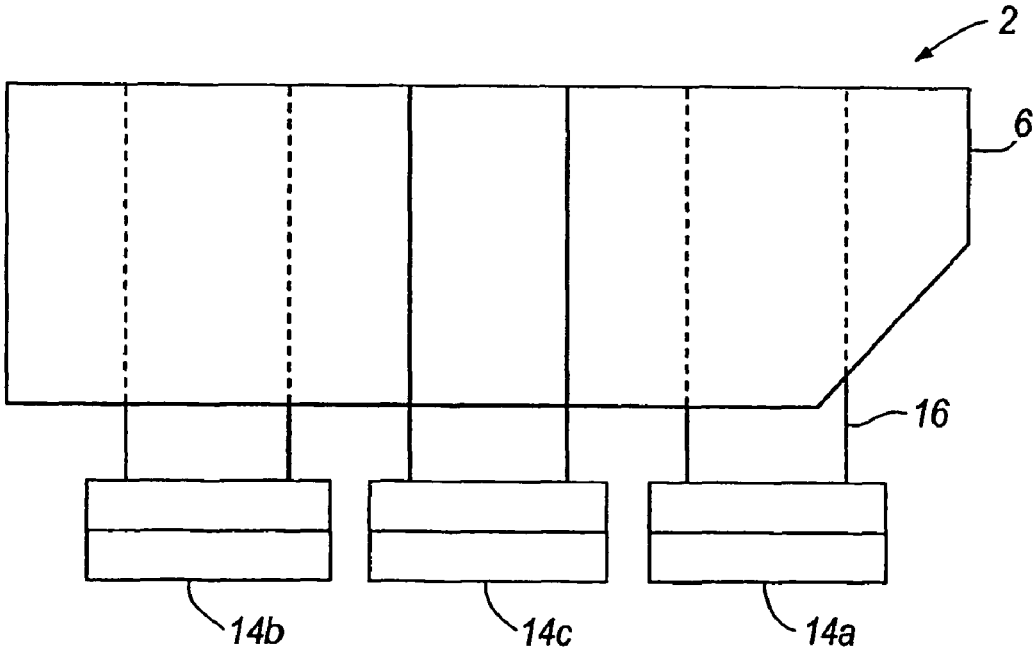
FIG. 5 is a side elevation view of the vessel of FIG. 4.

FIGS. 4 and 5 show an alternative arrangement for the tubes on the vessel. This is known as the asymmetric arrangement.

In this case two tubes 14 are suspended close to the port side 8 and one tube is suspended close to the starboard side 10. One port side tube 14*a* is located near the bow of the vessel and one port side tube 14*b* is located near the stern of the vessel. The starboard side tube 14*c* is located amidships. Of course, there could alternatively be two tubes on the starboard side and only one tube on the port side.

Figure 6:
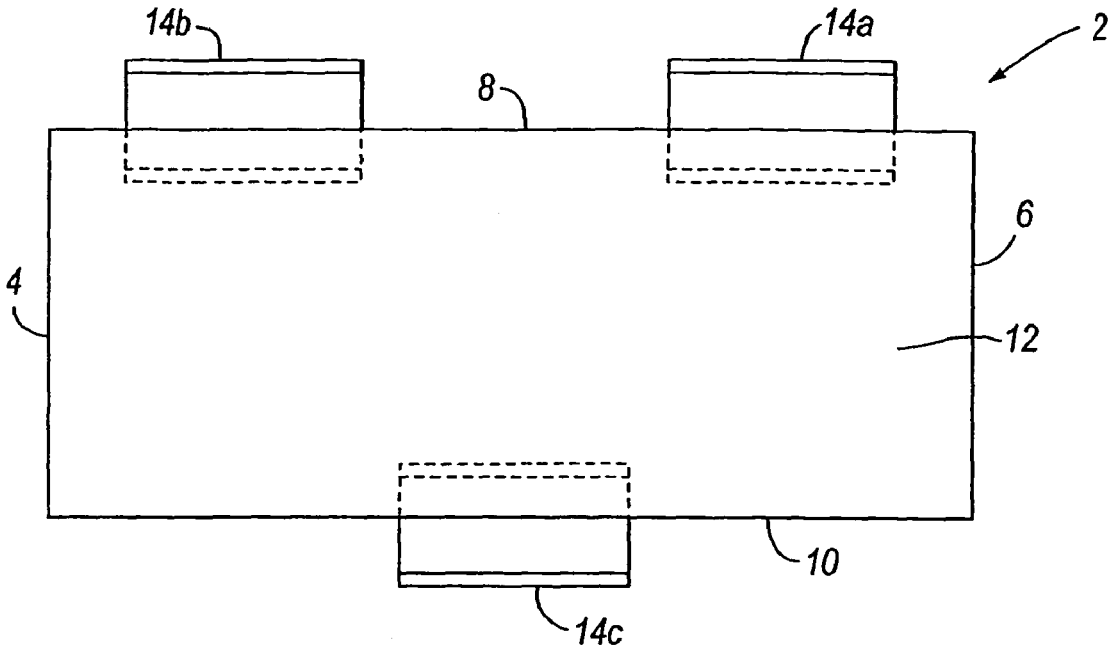
FIG. 6 is a plan view of a vessel having a second alternative stabilizing arrangement.
Figure 7:
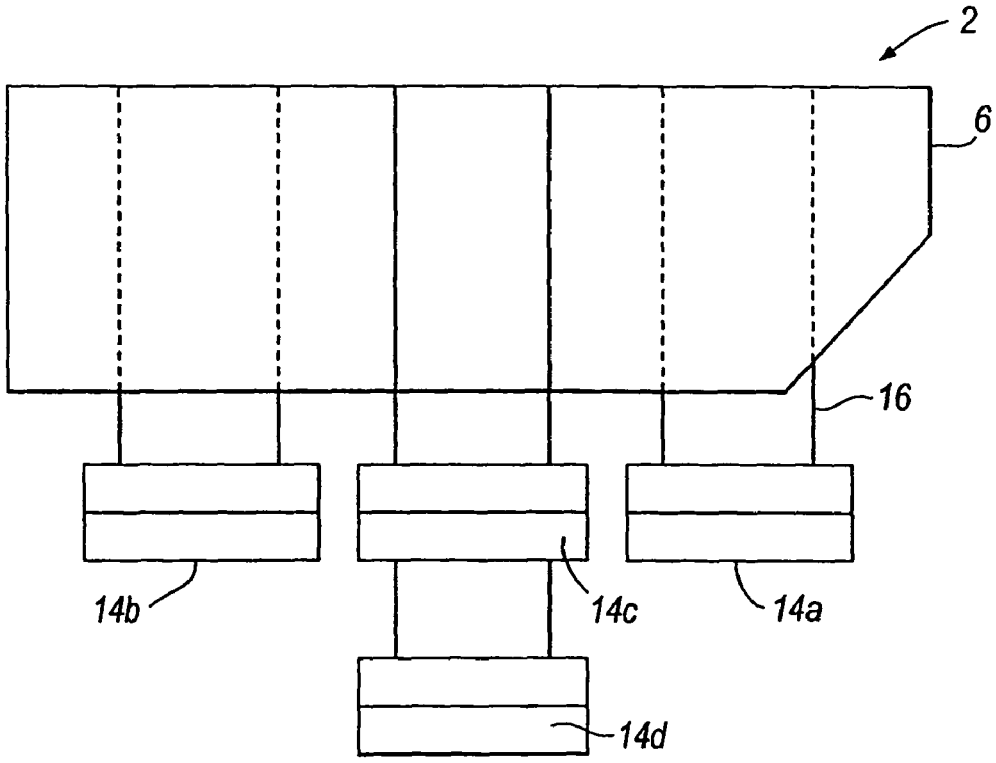
FIG. 7 is a side elevation view of the vessel of FIG. 6.

FIGS. 6 and 7 show another alternative arrangement for the tubes on the vessel. This is known as the ladder arrangement.

In this case two tubes 14 are suspended close to the port side 8 and two tubes are suspended close to the starboard side 10. One port side tube 14*a* is located near the bow of the vessel and one port side tube 14*b* is located near the stern of the vessel. Both starboard side tubes are located amidships, the second starboard side tube 14*d* being suspended beneath the first starboard side tube 14*c*. Of course, there could alternatively be two tubes amidships on the port side, one stern starboard side tube and one bow starboard side tube.

Alternative arrangements are also envisaged, which are not explicitly illustrated, for example a double ladder arrangement having two tubes amidships on the port side and two tubes amidships on the starboard side.

Figure 8:
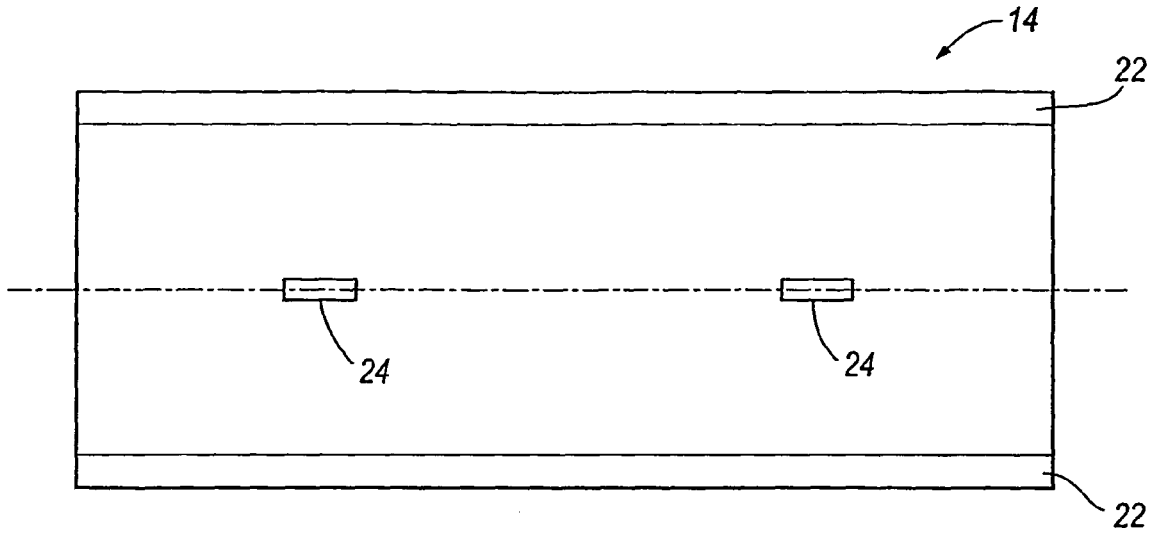
FIG. 8 is a plan view of a stabilizing tube.
Figure 9:
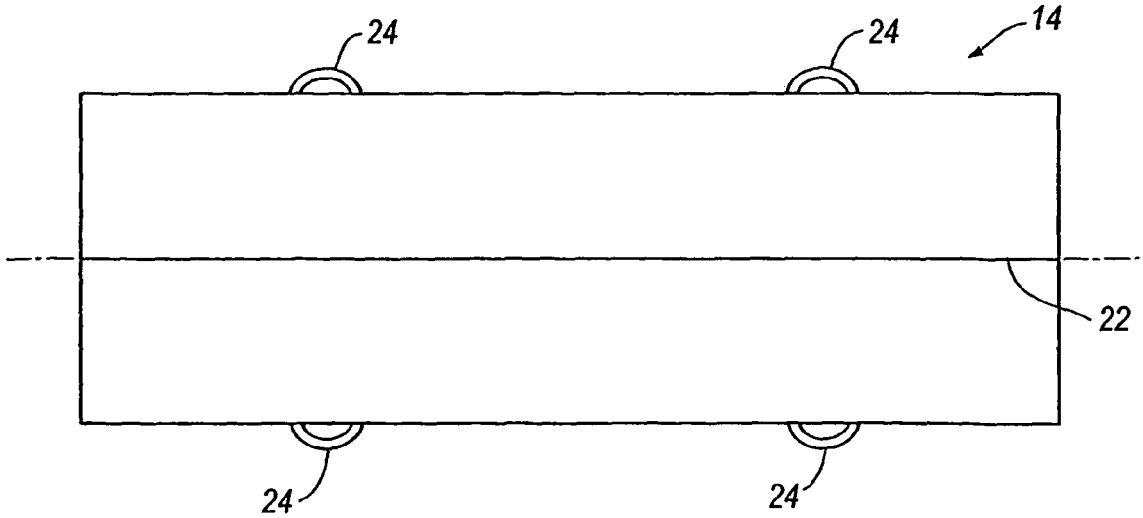
FIG. 9 is a side elevation view of the tube of FIG. 8.

FIGS. 8 and 9 show the tubes 14 in more detail. Each tube 14 has two horizontal fins 22 projecting from the tube 14.

Each tube 14 also has lifting points 24 shown schematically in FIGS. 8 and 9. On the tube 14 shown in FIG. 9 there are four lifting points 24, two on the upper side of the tube and two on the lower side. The two lifting points 24 on the upper side allow the chains 16 to be attached for suspending the tubes from the vessel. The two lifting points 24 on the lower side are only useful when the tube is used in the ladder arrangement shown in FIGS. 6 and 7. However, in many cases, it is advantageous for all the tubes to have four lifting points 24 so that the construction of every tube is the same and any tube can be used in any application.

Figure 10:
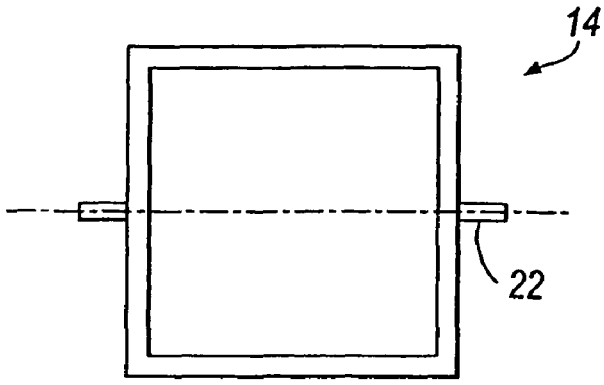
FIG. 10 is a cross sectional view of a stabilizing tube having an alternative construction.
Figure 11:
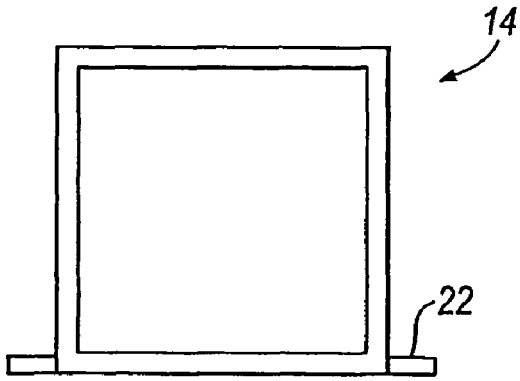
FIG. 11 is a cross sectional view of a stabilizing tube; having a second alternative construction.

FIGS. 10 and 11 show a tube 14 having a square cross section. Such a cross section gives the tube a greater drag through the water. In FIG. 10 the horizontal fins project from the side of the square tubes. In FIG. 11, the horizontal fins project from the base of the square tubes.

Figure 12:
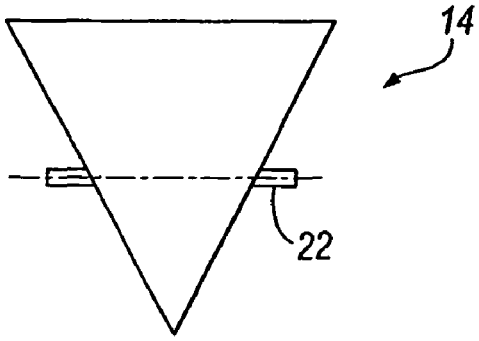
FIG. 12 is a cross sectional view of a stabilizing tube having a third alternative construction.

FIG. 12 shows a tube 14 having a triangular cross section. Such a cross section gives the tube increased drag when moving vertically upward but reduced drag when moving vertically downward. As the vessel rolls, the port side and the starboard side alternately rise and fall. As the port side falls, the tubes on the port side are required to move downwards through the water. It is therefore advantageous if there is as little drag in the downwards direction as possible. Conversely, as the port side rises, the tubes on the port side are required to resist movement upwards through the water. It is therefore advantageous if there is as much drag in the upwards direction as possible.

Other cross sectional shapes may also be envisaged and these shapes will have different effects on the speed and acceleration of the tubes in the water, as the vessel rolls.

It is particularly advantageous if the size and shape of the tubes takes into account the use of the tubes in other applications. Additionally, the storage of the tubes should be considered. For example, in the field of offshore oil and gas, the tubes may be storable horizontally on the deck of a stationary structure, on a vessel or on shore. Alternatively, the tubes may be stored in the sea when they are not in use.

They may, for example, be stored horizontally on the sea bed, preferably with a warning buoy floating on the sea above them, or a group of tubes may be rotated into upright positions, tied together and moored at sea in a floating arrangement with parts of the tubes projecting upwards above the surface and parts submerged below the surface.

When considering the effect of the stabilizing apparatus on the rolling motion of the vessel, there are two factors to be considered: the frequency of the rolling motion and the amplitude of the rolling motion. The natural frequency of the rolling is dependent on the mass of the system, since, as the mass of the tubes increases, the natural period of the rolling motion of the vessel increases. The amplitude of the rolling is dependent on the damping forces applied to the system and as the damping force increases, the amplitude will decrease i.e. the amplitude is dependent on the geometry of the tubes. Thus, as the diameter of the tubes and the size of the fins increases, the amplitude of the rolling motion of the vessel decreases.

Figure 13:
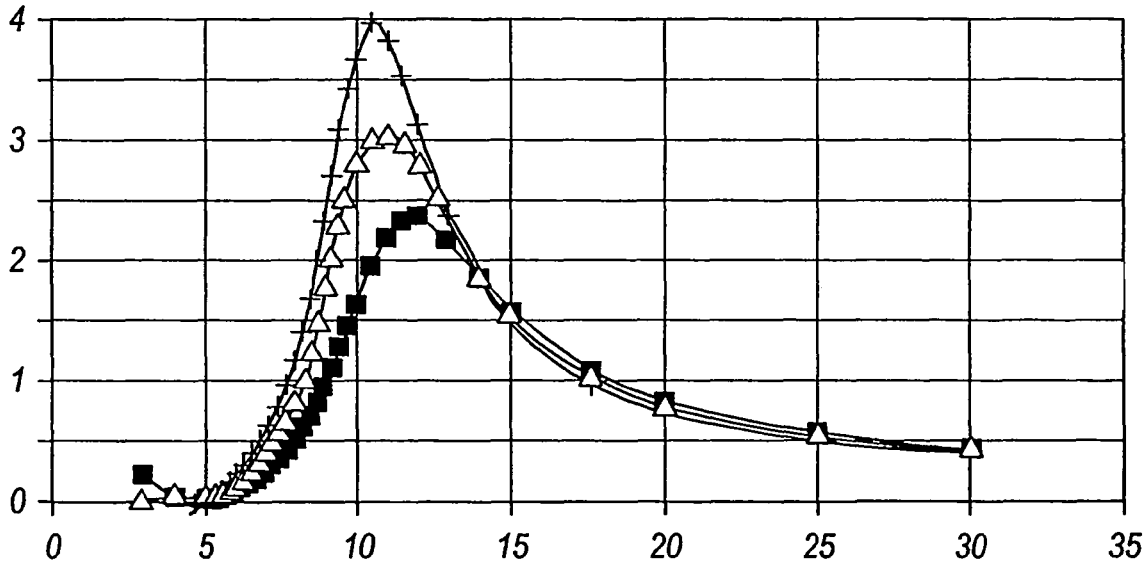
FIG. 13 is a plot showing the effect of the stabilizing arrangement on the degree and period of rolling motion.

Referring to FIG. 13, the effect of the stabilizing apparatus can be seen very clearly. FIG. 13 shows the amplitude of rolling as a function of the period of the applied wave motion. The x-axis shows the period in seconds and the y-axis the roll RAO in deg/m. The top plot is the base case i.e. the vessel without any stabilizing apparatus.

It can be seen that the natural period of the vessel is close to 10 s. The middle plot is a middle case where the vessel is fitted with stabilizing apparatus in which the tubes have a diameter of 3 m and the fins project 500 mm. It can be seen that the natural period of the vessel is close to 11 s. The bottom plot is a further case where the vessel is fitted with stabilizing apparatus in which the tubes have a diameter of 5 m and the fins project 500 mm. It can be seen that the natural period of the vessel is close to 12 s.

Thus, it can be seen clearly from FIG. 13 that the effect of the stabilizing apparatus is to reduce the amplitude of the rolling motion of the vessel (i.e. the peak of the curves decreases) and to increase the period of the rolling motion of the vessel (i.e. the peak of the curves moves to the right in the x-direction).

The description above is somewhat simplified and, as previously mentioned, there are many other variables which will affect the amplitude and period of the rolling motion e.g. the cross-sectional shape of the tubes and the size and shape of the fins.

Whilst certain specific embodiments of the invention have been described, it should be understood that many variations are possible. In particular, if the tubes 14 are not in use stabilizing a vessel, they may be put to a variety of other uses. For example a tube may be floated with its longitudinal axis horizontal and used as a mooring buoy.

Alternatively it may be used as a flotation tank for transporting a structure and may further be used, after appropriate ballasting, for raising a structure from the seabed or lowering a structure to the seabed.

The invention claimed is:

1. In combination, a vessel, a first stabilizer assembly and a second stabilizer assembly, each stabilizer assembly comprising:

at least a first submergible at least partially hollow body comprising at least one closed ballast tank of adjustable ballast;

suspending means for suspending the or each body below the vessel such that the or each first body is fully submerged below the water line of the vessel and above the seabed and is movable vertically relative to the seabed, at least one saddle attached to a hull of the vessel for supporting the suspending means and for transferring loads from the suspending means to the vessel, and the first and second stabilizer assemblies being suspended from substantially opposite respective sides of the vessel, wherein a top of the suspending means of the first stabilizer assembly is connected to a top of the suspending means of the second stabilizer assembly by a connection which is structurally separate from the vessel.

2. The combination according to claim 1 wherein the first stabilizer assembly further comprises:

a second submergible at least partially hollow body suspended from the first body.

3. The combination according to claim 1 further comprising a third stabilizer assembly, the third stabilizer assembly comprising:

at least a first submergible at least partially hollow body: and suspending means extendable below the water line for suspending the or each first body of the third stabilizer assembly from the vessel.

4. The combination according to claim 3 wherein the third stabilizer assembly comprises:

a second submergible hollow body suspended from the first body of the third stabilizer assembly.

5. The combination according to claim 3 further comprising a fourth stabilizer assembly, the fourth stabilizer assembly comprising:

at least a first submergible at least partially hollow body; and suspending means extendable below the water line for suspending the or each first body of the fourth stabilizer assembly from the vessel.

6. The combination according to claim 5 wherein the first stabilizer assembly is suspended near the bow of the vessel on one side, the second stabilizer assembly is suspended near the bow of the vessel on the other side, the third stabilizer assembly is suspended near the stern of the vessel on said one side and the fourth stabilizer assembly is suspended near the stern of the vessel on the other side.

7. The combination according claim 1 wherein the suspending means is capable of bearing high tension loads.

8. The combination according to claim 7 wherein the suspending means is capable of bearing tension loads of more than one hundred times the loads it is capable of bearing in compression.

9. The combination according to claim 7 wherein the suspending means comprises elongate flexible members.

10. The combination according to claim 9 wherein the elongate flexible members are chains.

11. The combination according to claim 1 wherein each body is of elongate shape and has a cross-sectional area greater than 4 $m^2$.

12. The combination according to claim 1 wherein each body comprises one or more closed or closable spaces having a combined volume of more than 50 $m^3$.

13. The combination according to claim 1 wherein the or each ballast tank is separately ballastable.

14. The combination according to claim 1 wherein each stabilizer assembly further comprises at least one fin projecting from the or each first body.

15. The combination according to claim 14 wherein the at least one fin is pivotable relative to the or each first body to restrict movement of the body upwardly through water more than downwardly.

16. The combination according to claim 1 wherein each first body is substantially prism shaped.

17. The combination according to claim 1 wherein each first body has a circular cross section.

18. The combination according to claim 1 wherein each first body has a rectangular cross section.

19. The combination according to claim 1 wherein each first body has a square cross section.

20. The combination according to claim 1 wherein each first body has a triangular cross section.

21. The combination according to claim 1 wherein one or both ends of each first body is substantially conical.

22. The combination according to claim 1, in which only vertical loads are arranged to be transferred from the suspending means to the vessel.

23. The combination as claimed in claim 1, wherein the vessel includes a deck, the suspending means of the first stabilizing assembly being connected to the suspending means of the second stabilizer assembly proximate a center of the deck.

24. The combination according to claim 1, wherein the load transfer structure is arranged to transmit only vertical loads from the suspending means to the vessel structure.

25. The combination according to claim 1, wherein each stabiliser assembly is arranged to apply via the suspending means as a downwardly directed force on the side of the vessel from which it is suspended when that side of the vessel moves upwards.

26. An apparatus for reducing vessel motion comprising a first stabilizer assembly and a second stabilizer assembly, each stabilizer assembly comprising:

at least one submergible at least partially hollow body including at least one closed ballast tank of adjustable ballast; and suspending means for suspending the or each body such that the or each body is fully submerged below the water line of the vessel and above the seabed and is movable vertically relative to the seabed, the first and second stabilizer assemblies being suitable for locating at substantially opposite portions of the vessel, wherein a top of the suspending means of the first stabilizer assembly is connected to a top of the suspending means of the second stabilizer assembly, the suspending means supported by at least one saddle for attaching to a hull of the vessel for supporting the suspending means and transferring loads from the suspending means to the vessel.

27. An apparatus according to claim 26 wherein each body is of elongate shape and has a cross-sectional area greater than 4 $m^2$.

28. An apparatus according to claim 26 wherein each body comprises one or more closed or closable spaces having a combined volume of more than 50 $m^3$.

29. An apparatus according to claim 26 wherein the or each ballast tank is separately ballastable.

30. An apparatus according to claim 28 wherein each stabilizer assembly further comprises at least one fin projecting from the or each body.

31. An apparatus according to claim 30 wherein the at least one fin is pivotable relative to the or each body to restrict movement of the body through water in one direction more than in another direction.

32. An apparatus according to claim 28 wherein each body is substantially prism shaped.

33. An apparatus according to claim 26 wherein each body has a circular cross section.

34. An apparatus according to claim 26 wherein each body has a rectangular cross section.

35. An apparatus according to claim 26 wherein each body has a square cross section.

36. An apparatus according to claim 26 wherein each body has a triangular cross section.

37. An apparatus according to claim 26 wherein one or both ends of each body is substantially conical.

38. A vessel in combination with a stabilizing apparatus according to claims 28.

39. A method for reducing motion of a water-borne vessel comprising:

suspending at least two at least partially hollow bodies each comprising at least one closed ballast tank below the water line of the vessel and above the seabed from substantially opposite sides of the vessel by respective first and second suspending means, wherein the bodies are vertically movable relative to the seabed, and further including the steps of connecting the first and second suspending means to each other in association with saddles attached to a hull of the vessel for providing support to the suspending means and transferring loads from the suspending means to the vessel.

40. In combination, a vessel, a first stabilizer assembly and a second stabilizer assembly, each stabilizer assembly comprising:

at least one submergible at least partially hollow body comprising at least one closed space of adjustable ballast;

saddles which increase the width of the vessel; and elongate flexible suspending means extendable beneath a water line of the vessel such that the or each body is fully submerged below the water line and is vertically movable relative to the seabed, the elongate flexible suspending means being capable of bearing tension loads of more than one hundred times the loads it is capable of bearing in compression, each stabilizer assembly being arranged to apply via its suspending means a downwardly directed force on a side of the vessel from which it is suspended when the side of the vessel moves upwards, the first and second stabilizer assemblies being suspended from substantially opposite sides of the vessel in association with the saddles, wherein the saddles are arranged to transfer the downwardly directed forces from the elongate flexible suspending means to the vessel.

41. In combination, a vessel, a first stabilizer assembly and a second stabilizer assembly, each stabilizer assembly comprising:

at least one submergible at least partially hollow body with a volume of more than 50 $m^3$, the hollow body comprising at least one closed ballast tank of adjustable ballast; and suspending means extendable below a water line of the vessel for suspending the or each body from the vessel such that the or each body is fully submerged below the water line and is vertically movable relative to the seabed, the suspending means being capable of bearing tension loads of more than one hundred times the loads it is capable of bearing in compression, the first and second stabilizer assemblies being suspended from substantially opposite sides of the vessel, the vessel further comprising one or more saddles for attaching to a hull of the vessel such that a width of the vessel is increased, the saddles arranged to support the suspending means such that the saddles transfer loads from the suspending means to the hull.

42. The combination as claimed in claim 41, wherein each body is substantially prism shaped.

43. The combination as claimed in claim 41, wherein each body has a circular cross section.

* * * * *